US006176549B1

(12) United States Patent
Karash

(10) Patent No.: US 6,176,549 B1
(45) **Date of Patent: *Jan. 23, 2001**

(54) DISPOSABLE HEAD-AND-NECK REST

(75) Inventor: Louis Stanley Karash, Hastings, NE (US)

(73) Assignee: Karding, Inc., Hastings, NE (US)

( * ) Notice: Under 35 U.S.C. 154(b), the term of this patent shall be extended for 0 days.

This patent is subject to a terminal disclaimer.

(21) Appl. No.: 09/246,340

(22) Filed: Feb. 9, 1999

Related U.S. Application Data

(63) Continuation-in-part of application No. 09/075,301, filed on May 8, 1998.

(51) Int. Cl.[7] ..... A47C 7/38

(52) U.S. Cl. ..... 297/391; 229/190

(58) Field of Search ..... 229/190, 195; 206/140, 139; 297/391, 397, 440.12, 423.41, 129, 118, 119, 188.01, 135; 5/622, 640, 628, 924, 637; 248/152, 174, 459, 346.4, 247, 248; 128/845, 846, 869, 870, 876

(56) References Cited

U.S. PATENT DOCUMENTS

| | | | |
|---|---|---|---|
| D. 282,802 | 3/1986 | Righini | D6/601 |
| 1,937,643 | 12/1933 | Drewry | 229/52 |
| 2,708,085 | 5/1955 | Bonaccorsi | 248/198 |
| 2,726,835 | 12/1955 | Hummel | 248/198 |
| 3,604,026 | 9/1971 | Schelps | 5/337 |
| 3,955,252 | 5/1976 | Reda | 27/12 |
| 4,154,478 | 5/1979 | Cohune | 297/397 |
| 4,274,673 | 6/1981 | Kifferstein | 297/220 |
| 4,300,683 | 11/1981 | Roccaforte | 206/485 |
| 4,339,151 | 7/1982 | Riggs | 297/464 |
| 4,518,086 | 5/1985 | Roccaforte | 206/485 |
| 4,526,316 | 7/1985 | Sutherland | 229/40 |
| 4,773,707 | 9/1988 | Vadala | 297/391 |
| 4,928,711 | 5/1990 | Williams | 128/869 |
| 4,964,418 | 10/1990 | Wilson | 128/857 |
| 5,115,524 | 5/1992 | Antosko | 5/99 |
| 5,146,641 | 9/1992 | Zwickey | 5/628 |
| 5,154,477 | 10/1992 | Lacy | 297/397 |
| 5,305,754 | 4/1994 | Honeywell et al. | 128/869 |
| 5,402,932 | 4/1995 | Fadaie | 229/195 |
| 5,503,456 | 4/1996 | Rossini | 297/397 |
| 5,579,551 | 12/1996 | Tommaney | 5/636 X |
| 5,639,019 | 6/1997 | Mayled | 229/195 |
| 5,944,016 | 8/1999 | Ferko, III | 128/869 |

FOREIGN PATENT DOCUMENTS 2274246 7/1994 (GB) .

*Primary Examiner*—Harry C. Kim
(74) *Attorney, Agent, or Firm*—Lathrop & Gage, LC

(57) ABSTRACT

A foldable combination head-and-neck rest and tray having a pair of opposed cardboard headrests detachably formed on a foundation. Each headrest may be folded to create a pair of spaced-apart triangular-shaped cup-holding regions on opposite sides of a base portion. The base portions and cup holding regions of the pair of opposed headrest define a storage area on the foundation. The headrests may be detached and folded to form a pair of head rests, which may be positioned behind a user's neck with the triangular shaped cup-holding regions serving as supports on opposite sides of the user's head.

5 Claims, 7 Drawing Sheets

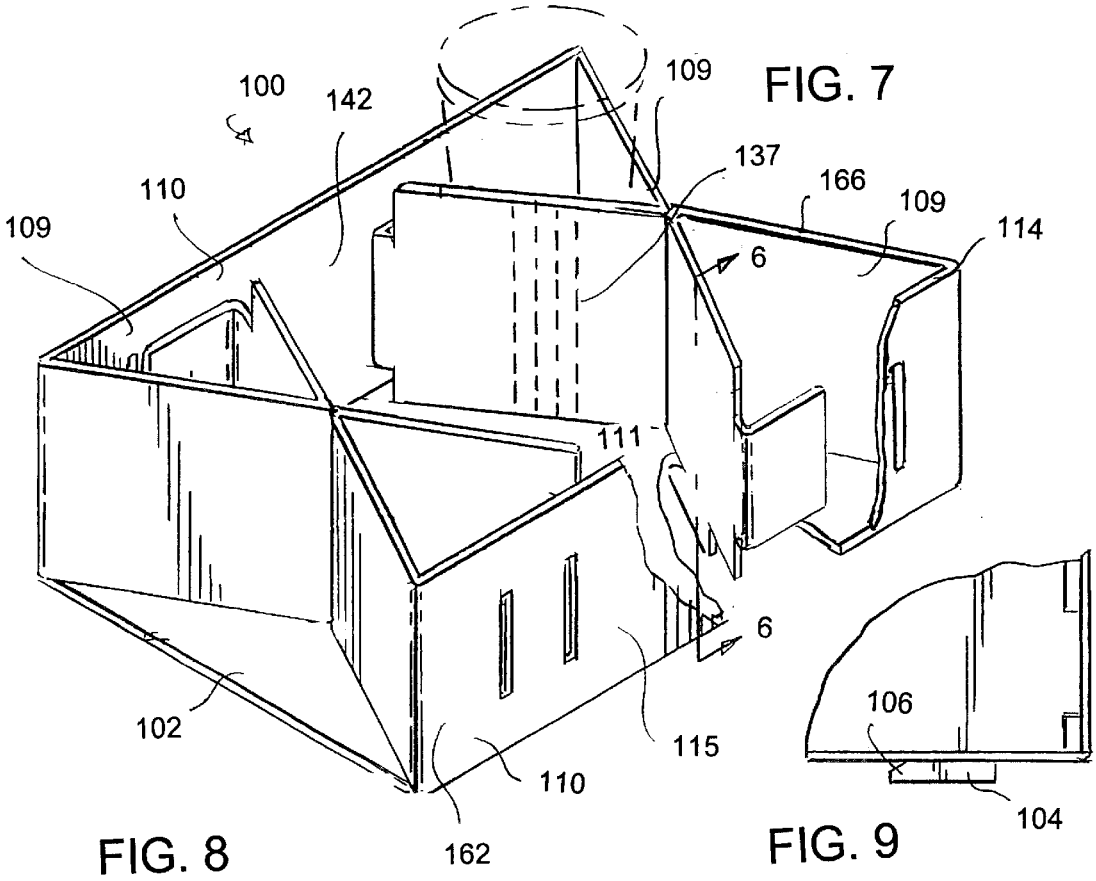
FIG. 7
FIG. 8
FIG. 9
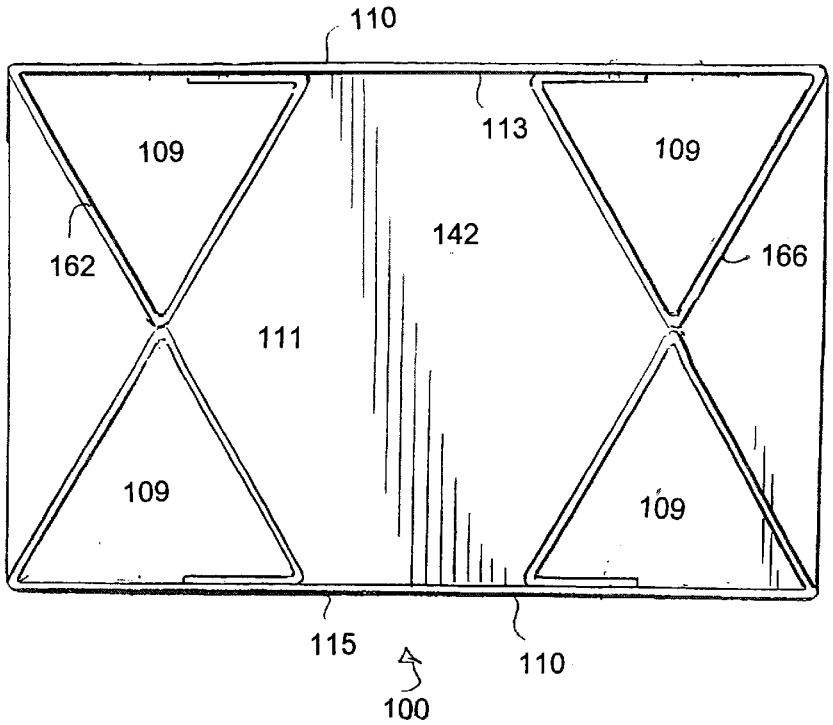

DISPOSABLE HEAD-AND-NECK REST

CROSS REFERENCE TO RELATED APPLICATION

This application is a continuation-in-part of co-pending application Ser. No. 09/075,301 filed on May 8, 1998.

BACKGROUND OF THE INVENTION

1. Field of the Invention

This invention relates to a head-and-neck rest and more particularly to an inexpensive, disposable head-and-neck rest.

2. Description of the Related Art

Many types of head-and-neck rests have been provided for use during travel. For example, head-and-neck rests are available that may be inflated to a horseshoe shape for positioning on either side of a person's neck or head. Other head-and-neck rests include horse-shoe-shaped members filled with beans or U-shaped and horse-shoe-shaped pillows. Although these neck supports do perform their intended function, they are expensive and must be re-packed after use so that they may be re-used at a later time. This re-use of head-and-neck rests between different consumers raises some health concerns.

Further, these head-and-neck rests also did not lend themselves to creative packaging whereby the headrest could function multiple uses, including advertising.

SUMMARY OF THE INVENTION

A disposable head-and-neck rest is provided which is formed from a generally rectangular member preferably comprised of a cardboard material with the rectangular member having a forward side, a rearward side, a top edge, a bottom edge, and first and second ends. The rectangular member has first, second, third and fourth fold lines formed therein. The first fold line extends between the top and bottom edges of the rectangular member inwardly of the first end thereof to define a first flap portion. The second fold line extends between the top and bottom edges of the rectangular member inwardly of the first fold line to define a second flap portion. The third fold line extends between the top and bottom edges of the rectangular member inwardly of the second end thereof to define a third flap portion. The fourth fold line extends between the top and bottom edges of the rectangular member inwardly of the third fold line to define a fourth flap portion. The second and fourth fold lines define a base portion therebetween. The first and second flap portions are foldable along the first and second fold lines to form a first triangular-shaped support. The third and fourth flap portions are foldable along the third and fourth fold lines to form a second triangular shaped portion. The first and second triangular-shaped supports are spaced apart to provide an area to receive the users neck or head therebetween. In the preferred embodiment, the first and second triangular-shaped supports are maintained in position by means of tabs having locking flaps. The tabs extend through the spaced-apart slots formed in the base portion, and the locking flap can be configured to maintain the head rest in position.

It is therefore a principal object of the invention to provide an improved novel head-and-neck rest.

Yet another object of the invention is to provide a disposable head-and-neck rest.

Yet another object of the invention is to provide a head-and-neck rest which is constructed from an inexpensive paper material so that the head-and-neck rest may be thrown away after use.

Yet another object of the invention is to provide a head-and-neck rest which may be folded flat prior to use but which may be folded to a shape wherein first and second supports are provided at opposite ends of the head-and-neck rest.

Yet another object of the invention is to provide a disposable head-and-neck rest which is convenient to use.

These and other objects will be obvious to those skilled in the art.

BRIEF DESCRIPTION OF THE DRAWINGS

FIG. 7 is a perspective view illustrating the combination head-and-neck rest/food tray embodiment of this invention;

FIG. 8 is a top view of the combination head-and-neck rest/food tray illustrating the manner in which it is being folded;

FIG. 9 is a partial side elevational view taken along line 9—9 of FIG. 4 which further illustrates the combination head-and-neck rest/food tray being folded;

DESCRIPTION OF THE PREFERRED EMBODIMENT

Figure 1:
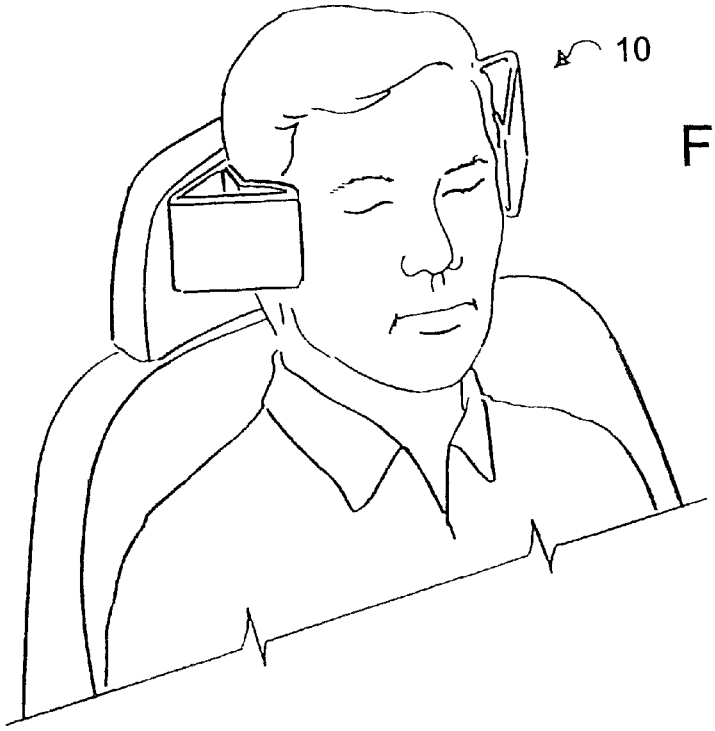
FIG. 1 is a perspective view illustrating a person using the head-and-neck rest of this invention.

The head-and-neck rest of this invention is referred to generally by the reference numeral 10 and is formed from a generally rectangular member 12 preferably constructed from corrugated board, cardboard, paper, plastic or other suitable material. In the preferred embodiment, the rectangular member 12 is constructed from a corrugated board material.

Rectangular member 12 will be generally described as including a front surface 13 and rear surface 15. Further, rectangular member 12 includes a top edge 14, bottom edge 16, and opposite ends 18 and 20. Tabs 22 and 24 extend outwardly from ends 18 and 20, respectively.

A first fold line 26 is formed in member 12 inwardly of end 18 and extends between the top edge 14 and bottom edge 16 to define a first flap portion 28. A second fold line 30 is formed in member 12 inwardly of fold line 26 and extends between the top edge 14 and bottom edge 16 to define a second flap portion 32. A third fold line 34 is formed in member 12 inwardly of end 20 and extends between the top edge 14 and bottom edge 16 to define a third flap portion 36. A fourth fold line 38 is formed in member 12 inwardly of third fold line 34 and extends between the top edge 14 and bottom edge 16 to define a fourth flap portion 40. For purposes of description, fold lines 30 and 38 define a base portion 42 therebetween.

First flap portion 28 and third flap portion 36 are configured with lines of weakness, generally indicated at 37, to provide flap portions 28 and 36 with pliancy as the head-and-neck rest is configured in the in-use position. Further, apertures 39 are formed in first flap portion 28 and third flap portion 36 to provide a passageway for the earpiece of headphones as the head-and-neck rest is used.

Figure 3:
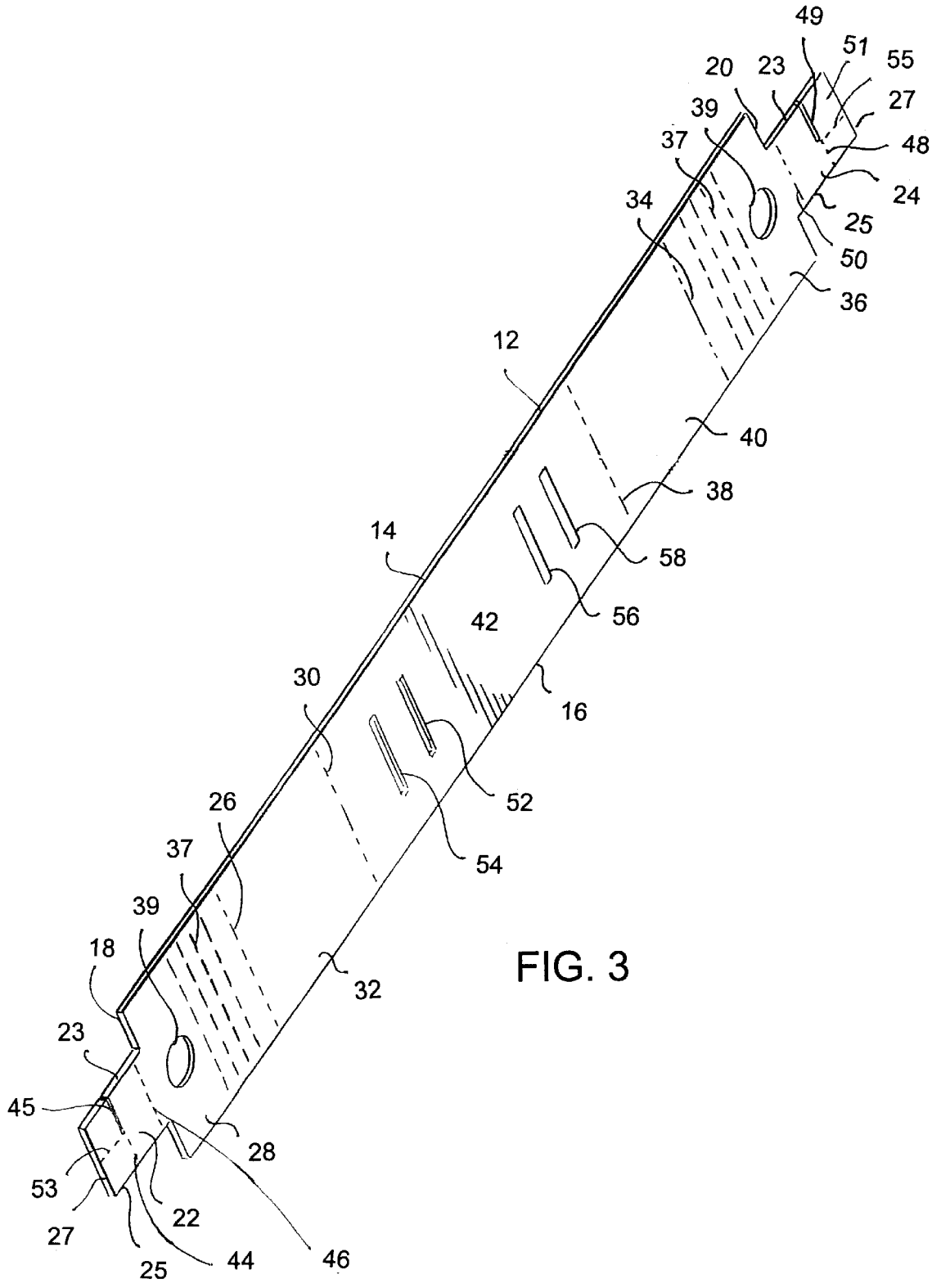
FIG. 3 is a perspective view illustrating the head-and-neck rest prior to it being folded to its operative position.
Figure 4:
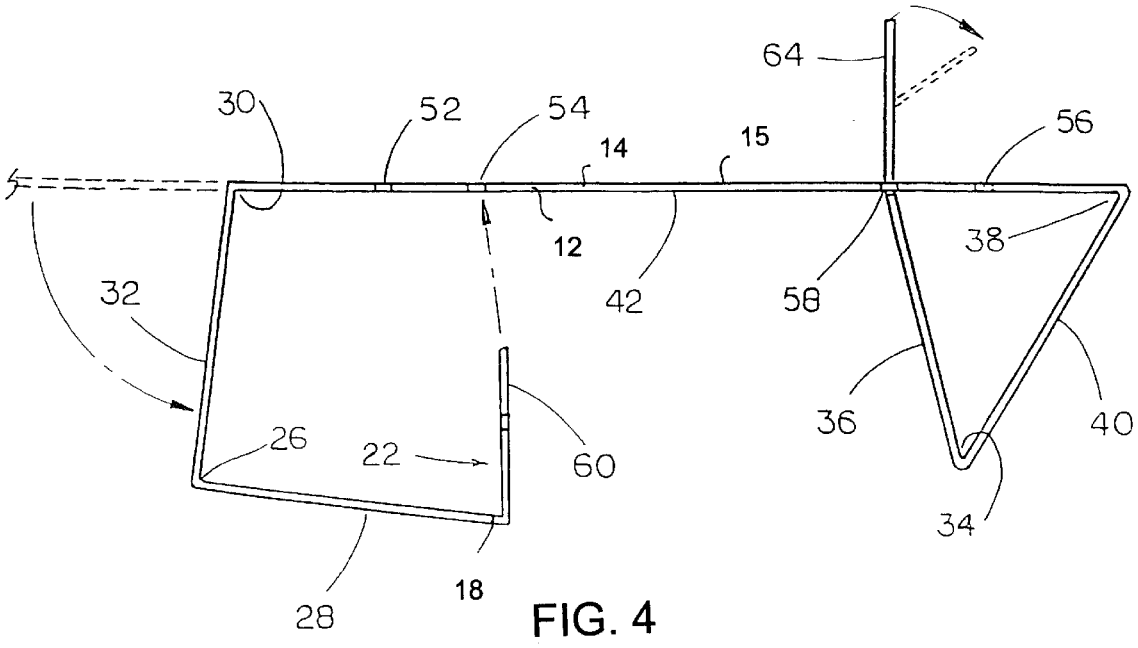
FIG. 4 is a top view illustrating the head-and-neck rest as it is being folded.

Tabs 22 and 24 each include a top edge 23, a bottom edge 25 and a distal end 27 As shown in FIG. 3, tab 22 is formed with fold lines 44 and 46 which extend between the top edge 23 and bottom edge 25 of tab 22. Likewise, tab 24 is formed with fold lines 48 and 50 which extend between the top edge 23 and bottom edge 25 of tab 24. Fold lines 44 and 48 of tabs 22 and 24 further include slits 45, 49 respectively, which extend from the approximately the mid-portion of fold lines 44 and 48 to the top edge 23. Slits 45 and 49 form one edge of locking flaps of tabs 47 and 51. Fold lines 53 and 55 define the other edge of locking flaps 47 and 51, respectively, and extend from the mid-portion of fold lines 44 and 48 to the distal end 27 of tabs 22 and 24. It will be understood that the locking flaps 47, 51 of tabs 22 and 24 could be formed on the bottom half of the tabs without departing from the scope of the present invention.

A pair of vertically disposed and horizontally spaced-apart slots 52 and 54 are formed in base portion 42 inwardly of fold line 30, as seen in FIG. 3. A pair of vertically disposed and horizontally spaced-apart slots 56 and 58 are formed in base portion 42 inwardly of fold line 38, as seen in FIG. 3.

Figure 6:
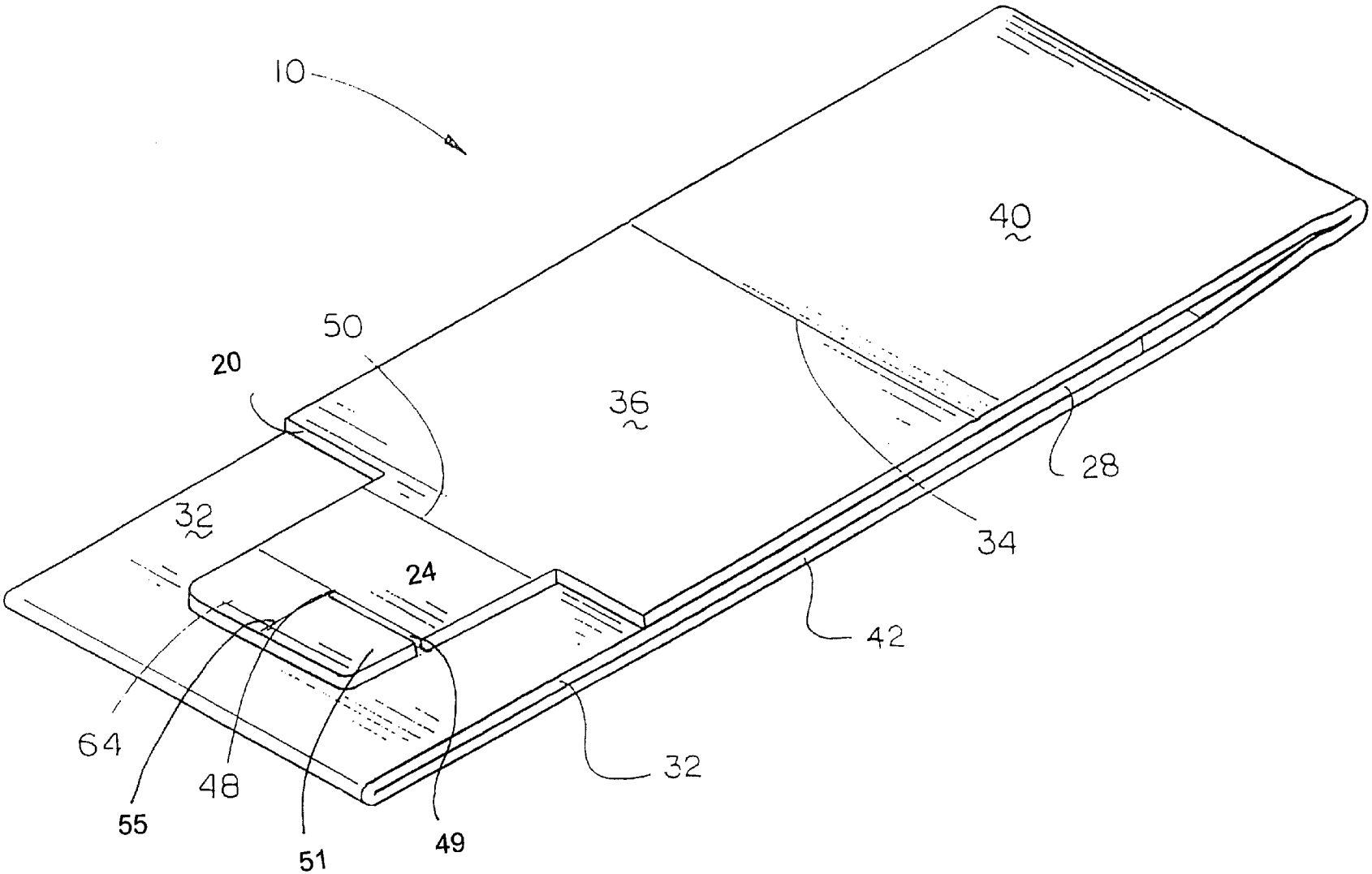
FIG. 6 is a perspective view of the head-and-neck rest.

It is contemplated that the head-and-neck rest of this invention will be sold or distributed to the users in the flat condition illustrated in FIG. 6 so that it may be easily stored and transported. Normally, the flap portions 28 and 32 would be transported in a position wherein the flap portions 28 and 32 are positioned against base portion 42. Similarly, it is contemplated that flap portions 36 and 40 would be folded adjacent the folded flap portions 28 and 32 to enable the head-and-neck rest to be easily stored and transported. It is also contemplated that if a travel agency or the like is distributing the head-and-neck rest, suitable advertising materials would be imprinted on the head-and-neck rest.

Figure 2:
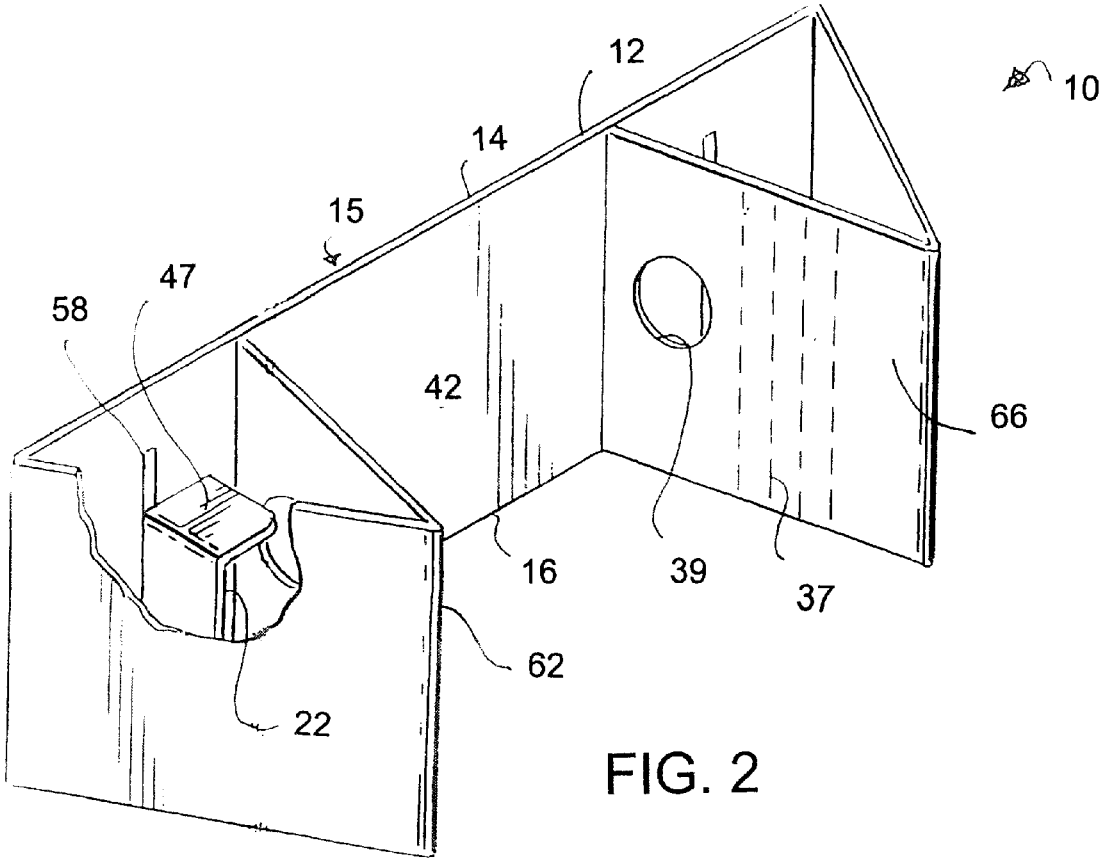
FIG. 2 is a perspective view of the head-and-neck rest of this invention with a portion cut-away to show the locking tab of the head-and-neck rest.
Figure 5:
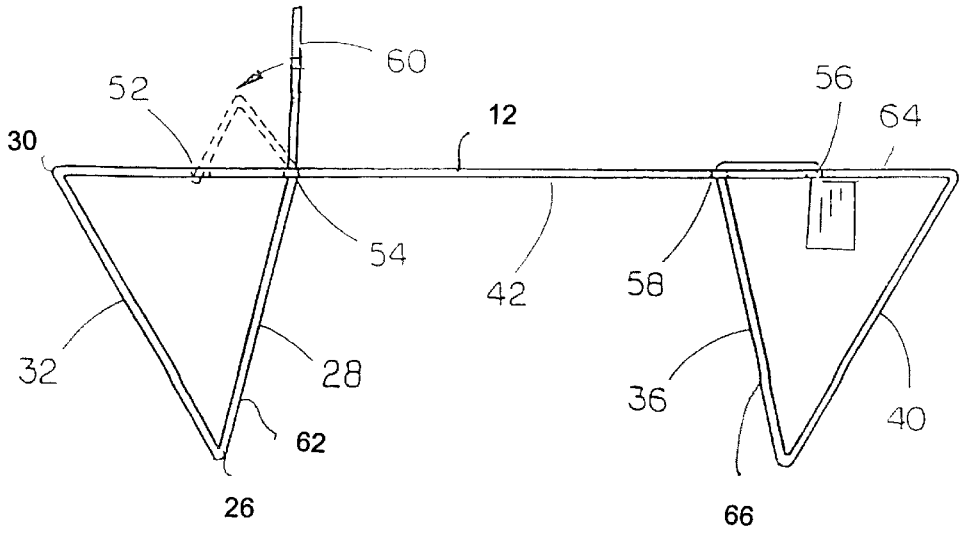
FIG. 5 is a top view illustrating the head-and-neck rest as it is being folded and maintained in the folded position by the locking tab.

Assuming that the head-and-neck rest is in the completely flat position illustrated in FIG. 3, the head-and-neck rest is formed as follows. Flap portion 32 is folded forwardly along fold line 30 and flap portion 28 is folded inwardly and rearwardly along fold line 26 so that tab 22 may be inserted through slot 54. Tab 22 is then folded along fold lines 44 and 46 so that the end portion 60 of tab 22 may be inserted through slot 52 from the back side of the head-and-neck rest, as illustrated by broken lines in FIG. 5. Locking tab 47 is then folded, as shown in FIG. 2, to lock flap portion 32 onto base portion 42. When the flap portions 28 and 32 have been folded as described, a triangular-shaped neck support 62 is created. It is important to note that when the triangular-shaped neck support 62 is formed, flap portion 28 extends inwardly and forwardly from base portion 42 and acts as a brace for the neck support 62.

Flap portion 40 is then folded forwardly with respect to base portion 42 along fold line 38 and flap portion 36 is folded inwardly and rearwardly with respect to flap portion 40 so that tab 24 may be inserted through slot 58. Tab 24 is then folded along fold lines 48 and 50 so that the end portion 64 of tab 24 may be extended forwardly through the slot 56 from the rearward side of the head-and-neck rest. Locking tab 51 is then folded, as shown in FIG. 2, to lock flap portion 32 onto base portion 42. When the flap portions 36 and 40 have been folded as described, a triangular-shaped neck support 66 is provided with the flap portion 40 serving as a brace for the support.

When the head-and-neck rest has been folded as just described, the head-and-neck rest may be positioned behind the user's head with a portion of the user's neck or head being positioned adjacent the front surface of base portion 42 and with the triangular-shaped neck supports 62 and 66 being positioned on opposite sides of the user's head or neck. The user may cause the supports 62 and 66 to more closely embrace their neck by increasing the rearward pressure against base portion 42.

Thus it can be seen that a novel disposable head-and-neck rest has been provided which is inexpensive to manufacture, easy to use and which may thrown away after use.

An alternative embodiment of the present invention is indicated generally at 100 and shows a combination head-and-neck rest/food tray. This combination headrest/tray 100 includes opposing head-and-neck rests 110 detachably formed on a foundation 102. The foundation is generally rectangularly shaped and preferably constructed from cardboard, paper, plastic or other suitable material.

Each head-and-neck rest 110 is a generally rectangular member 112 which includes a front surface 113, a rear surface 115, a top edge 114, a bottom edge 116, and opposite ends 118 and 120. Tabs 122 and 124 extend outwardly from ends 118 and 120, respectively. A first fold line 126 is formed in each member 112 inwardly of end 118 and extends between the top edge 114 and bottom edge 116 to define a first flap portion 128. A second fold line 130 is formed in each member 112 inwardly of fold line 126 and extends between the top edge 114 and bottom edge 116 to define a second flap portion 132. A third fold line 134 is formed in member 112 inwardly of end 120 and extends between the top edge 114 and bottom edge 116 to define a third flap portion 136. A fourth fold line 138 is formed in member 112 inwardly of third fold line 134 and extends between the top edge 114 and bottom edge 116 to define a fourth flap portion 140. For purposes of description, fold lines 130 and 138 define a base portion 142 therebetween for each head rest. First flap portion 128 and third flap portion 136 are configured with lines of weakness, generally indicated at 137.

A pair of vertically disposed and horizontally spaced-apart slots 152 and 154 are formed in base portion 142 inwardly of fold line 130, as seen in FIG. 3. A pair of vertically disposed and horizontally spaced-apart slots 156 and 158 are formed in base portion 142 inwardly of fold line 138, as seen in FIG. 3.

The opposed head-and-neck rests 110 are each configured with a pair of fastening tabs 104 at the first and third flap portions 128, 136, respectively, of each head rest. The fastening tabs 104 extend from the bottom edge 116 of each head rest 110 downwardly and include an inwardly extending finger 106.

The foundation 102 of the combination head-and-neck rest/food tray is a generally rectangular piece that is formed with four angularly disposed slots 108 for accepting the fastening tabs 104 of each head rest 110. The head-and-neck rests 110 are formed on the foundation such that as folded on the foundation, the front surfaces of the head-and-neck rests are facing one another.

Figure 10:
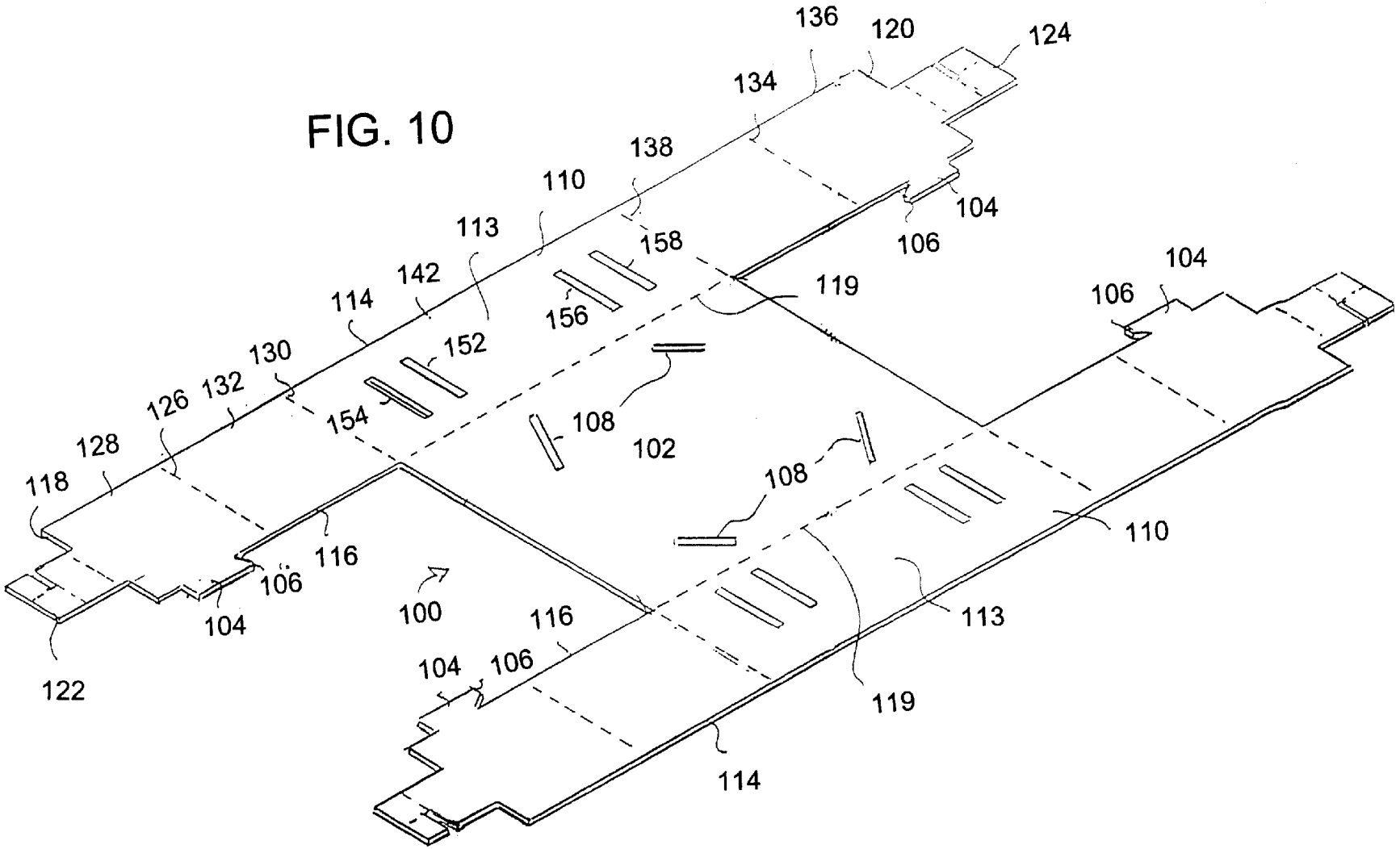
FIG. 10 is a perspective view illustrating the combination head-and-neck rest/food tray prior to it being folded to its operative position.

The head-and-neck rests 110 can be folded on the foundation to serve as a food tray as shown in FIG. 7. To form a food tray and assuming that the combination head-and-neck rest/food tray is in the completely flat position illustrated in FIG. 10, each head-and-neck rest portion 110 is formed as follows. Flap portion 132 is folded forwardly along fold line 130 and flap portion 128 is folded inwardly and rearwardly along fold line 126 so that tab 122 may be folded along fold line 146 so that the end portion 160 of tab 122 may be adhered to the front surface of base 142. When the flap portions 128 and 132 have been folded as described, a first triangular-shaped, cup-holding region 109 is created. The cup-holding region is maintained in place by inserting the fastening tabs 104 through the slots 108 provided in the foundation 102. The inwardly extending finger 106 of each fastening tab 104 assists in maintaining the cup holding regions. As folded in this manner, the four cup-holding regions 109 and two base portions 142 of the headrests further define an interior carrying compartment 111, as shown in FIGS. 7 and 8.

To transition the combination head-and-neck rest from the food tray to a pair of head-and-neck rest, the head-and-neck rests 110 may simply be removed from the foundation by removing the fastening tabs from the slots 108 and detaching the head-and-neck rest by tearing along a line of weakness 119 formed at the transition region between head-and-neck rest 110 and foundation 102.

Figure 11:
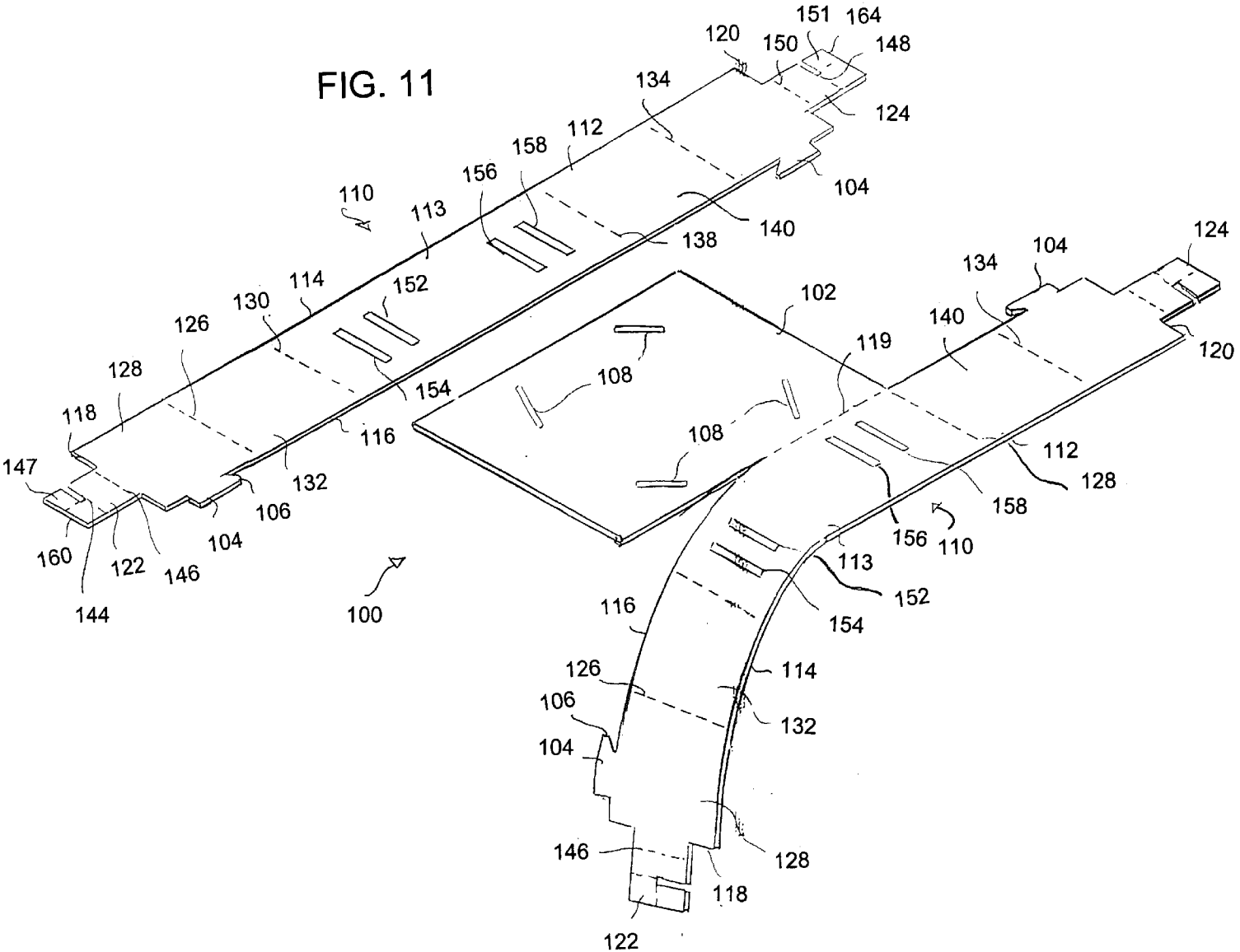
FIG. 11 is a perspective view illustrating the head-and-neck rest being separated from the food tray of this invention.

The combination head-and-neck rest/food tray 100 may also be formed into a pair of head rests from a flat position, unfolded position, as shown in FIG. 11. The head-and-neck rests are formed as follows. Each head-and-neck rest portion 110 is detached from foundation 102 by tearing along a line of weakness 113 formed at the transition region between head-and-neck rest 110 and foundation 102. Flap portion 132 is folded forwardly along fold line 130 and flap portion 128 is folded inwardly and rearwardly along fold line 126 so that tab 122 may be inserted through slot 154. Tab 122 is then folded along fold lines 144 and 146 so that the end portion 160 of tab 122 may be inserted through slot 152 from the back side of the head-and-neck rest. Locking tab 147 is then folded to lock flap portion 132 onto base portion 142. When the flap portions 128 and 132 have been folded as described for each head-and-neck rest 110, a triangular-shaped neck support is created. It is important to note that when the triangular-shaped neck support is formed, flap portion 128 extends inwardly and forwardly from base portion 142 and acts as a brace for the neck support.

Flap portion 140 is then folded forwardly with respect to base portion 142 along fold line 138 and flap portion 136 is folded inwardly and rearwardly with respect to flap portion 140 so that tab 124 may be inserted through slot 158. Tab 124 is then folded along fold lines 148 and 150 so that the end portion 164 of tab 124 may be extended forwardly through the slot 156 from the rearward side of the head-and-neck rest. Locking tab 151 is then folded to lock flap portion 132 onto base portion 142. When the flap portions 136 and 140 have been folded as described, a triangular-shaped neck support is provided with the flap portion 140 serving as a brace for the support.

When the head-and-neck rest has been folded as just described, the head-and-neck rest 110 may be positioned behind the user's head with a portion of the user's neck or head being positioned adjacent the front surface of base portion 142 and with the triangular-shaped neck supports 162 and 166 being positioned on opposite sides of the user's head or neck.

Accordingly, it can be seen that the invention accomplishes at least all of its stated objectives.

What is claimed is:

1. A foldable head-and-neck rest, comprising a generally rectangular member having a forward side, a rearward side, a top edge, a bottom edge, and first and second ends;

said rectangular member having a first tab extending from said first end, said first tab having a locking tab foldable relative to the remainder of the first tab such that the locking tab is selectively pivotable to a non-aligned position with respect to the remainder of the first tab, and said rectangular member having a second tab extending from said second end, said second tab having a locking tab foldable relative to the remainder of the second tab such that the locking tab is selectively pivotable to a non-aligned position with respect to the remainder of the second tab;

said rectangular member further having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion;

said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween, said base portion having first and second slots formed therein inwardly of said second fold line and having third and fourth slots formed therein inwardly of said fourth fold line;

said first and second flap portions being foldable along said first and second fold lines to form a first triangular-shaped support;

said third and fourth flap portions being foldable along said third and fourth fold lines to form a second triangular-shaped support;

said first and second triangular-shaped supports being spaced-apart to provide an area to receive a user's head therebetween;

said first tab of said rectangular member being received by said first and second slots when said first and second flap portions have been folded to form said first triangular-shaped support;

said second tab being received by said third and fourth slots when said third and fourth flap portions have been folded to form said second triangular-shaped support;

said locking tabs of said first and second tabs as folded into the non-aligned position abutting a portion of the base portion of the head-and-neck rest so as to prevent movement of the first and second tabs relative to the slots to lock said first and second triangular-shaped supports in their said folded position.

2. The head-and-neck rest of claim 1 wherein said first and third flap portions are configured with apertures to provide a passageway from interiorly of said first and second triangular shaped supports to said forward side of said base portion.

3. A transformable head-and-neck rest and food tray, comprising:

a foundation member having opposites ends and a pair of rectangular members each having a forward side, a rearward side, a top edge, a bottom edge, and first and second ends, said pair of rectangular members being detachably formed on opposite sides of the foundation member; each of said pair of rectangular members having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion;

said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween;

said first and second flap portions being foldable along said first and second fold lines to form a first triangular-shaped portion;

said third and fourth flap portions being foldable along said third and fourth fold lines to form a second triangular-shaped portion;

said first and second triangular-shaped portions being spaced-apart to provide an area therebetween; wherein as the pair of rectangular members are folded onto the foundation member said first and second triangular-shaped portions of each of said pair of rectangular members form cup-holding regions and said area between said first and second triangular-shaped portions of each of said pair of rectangular members form a carrying compartment; and wherein said pair of rectangular members are selectively detachable from said foundation member to form at least one head-and neck rest.

4. The transformable head-and-neck rest and food tray of claim 3 wherein the foundation member further includes a plurality of slots and wherein said pair of rectangular members each further include at least one fastening tab mateable with the plurality of slots of the foundation member.

5. The transformable head-and-neck rest and food tray of claim 3 wherein a locking tab is formed on said first and second triangular-shaped portions of each of said pair of rectangular members to maintain said first, second, third and fourth flap portions in their folded positions.

* * * * *